US007927256B2

(12) United States Patent
Flentye et al.

(10) Patent No.: US 7,927,256 B2
(45) **Date of Patent: *Apr. 19, 2011**

(54) ADJUSTABLE EXERCISE DEVICE AND A DEVICE FOR ADJUSTING AN EXERCISE DEVICE

(75) Inventors: Herbert T. Flentye, Glenview, IL (US); Gregory Niederlander, Gurnee, IL (US)

(73) Assignee: Spri Products, Inc., Libertyville, IL (US)

( * ) Notice: Subject to any disclaimer, the term of this patent is extended or adjusted under 35 U.S.C. 154(b) by 82 days.

This patent is subject to a terminal disclaimer.

(21) Appl. No.: 11/381,915

(22) Filed: May 5, 2006

(65) Prior Publication Data

US 2006/0189449 A1 Aug. 24, 2006

Related U.S. Application Data

(63) Continuation-in-part of application No. 10/806,631, filed on Mar. 23, 2004, now abandoned.

(60) Provisional application No. 60/457,193, filed on Mar. 25, 2003.

(51) Int. Cl.
*A63B 22/00* (2006.01)
*A63B 22/04* (2006.01)
*A63B 26/00* (2006.01)

(52) U.S. Cl. ..... 482/52; 482/51; 482/142

(58) Field of Classification Search ..... 482/52, 482/142, 19, 26; D21/336; 248/346.5, 188.2; 108/106; 446/117

See application file for complete search history.

(56) References Cited

U.S. PATENT DOCUMENTS

| | | | | |
|---|---|---|---|---|
| 3,381,928 | A * | 5/1968 | White | 248/455 |
| 4,073,454 | A | 2/1978 | Sauber | |
| 4,253,661 | A | 3/1981 | Russell | |
| 4,678,234 | A | 7/1987 | Wilson | |
| 4,905,330 | A * | 3/1990 | Jacobs | 5/705 |
| D330,057 | S | 10/1992 | Saunders | |
| D330,234 | S | 10/1992 | Saunders | |
| 5,158,512 | A * | 10/1992 | Irwin et al. | 482/52 |
| 5,162,028 | A | 11/1992 | Wilkinson | |
| 5,169,360 | A | 12/1992 | Saunders | |
| 5,269,735 | A | 12/1993 | Pfitzenmeier | |
| D343,433 | S | 1/1994 | Crosson | |

(Continued)

FOREIGN PATENT DOCUMENTS

ES 1 057 213 7/2004

OTHER PUBLICATIONS

Office Action dated May 21, 1991 for U.S. Appl. No. 07/418,159.

(Continued)

*Primary Examiner* — Nicholas D Lucchesi
*Assistant Examiner* — Sundhara M Ganesan
(74) *Attorney, Agent, or Firm* — Barnes & Thornburg LLP

(57) ABSTRACT

An adjustable exercise device that includes one or more inclined riser blocks for readily elevating and inclining a platform to enable stepping and other exercises to be readily performed on an inclined platform. The inclined riser blocks may be matingly engageable with the bottom of the platform to elevate and incline the platform. The inclined riser block may include a top face matingly engageable with the bottom of the platform, a bottom face, and a central portion extending between the bottom and top faces and having a front and rear, the central portion increasing in thickness from the front to the rear. The top face extends at an incline.

14 Claims, 8 Drawing Sheets

U.S. PATENT DOCUMENTS

| | | | | |
|---|---|---|---|---|
| 5,318,489 | A * | 6/1994 | Irwin | 482/52 |
| D367,369 | S | 2/1996 | Lovegrove et al. | |
| 5,620,404 | A | 4/1997 | Eyman | |
| 5,651,753 | A | 7/1997 | Wilkinson | |
| 5,656,000 | A | 8/1997 | Russell | |
| 5,672,144 | A | 9/1997 | Hulme | |
| 5,823,488 | A | 10/1998 | Nettekoven | |
| 5,954,303 | A | 9/1999 | Wolf et al. | |
| 6,089,667 | A | 7/2000 | Hobbs | |
| 6,374,556 | B2 | 4/2002 | Crant et al. | |
| 6,926,643 | B1 | 8/2005 | Gvoich | |
| 7,044,901 | B2 | 5/2006 | Weir | |

OTHER PUBLICATIONS

Office Action dated Jul. 6, 1992 for U.S. Appl. No. 07/849,286.

Sportime ("Step' for Rehab, Not Just for Aerobics." Abilitations Spring 1995: 114).

* cited by examiner

ADJUSTABLE EXERCISE DEVICE AND A DEVICE FOR ADJUSTING AN EXERCISE DEVICE

This application is a continuation-in-part application of U.S. patent application Ser. No. 10/806,631 filed Mar. 23, 2004, which claims priority to provisional application No. 60/457,193 filed Mar. 25, 2003.

BACKGROUND AND SUMMARY

The present disclosure relates to an adjustable exercise device for aerobic stepping exercise and other forms of exercise and to a device for adjusting an exercise device.

The Step exercise device, available from Escalade Sports of Evansville, Ind., is a well known aerobic stepping structure that includes a platform and a number of riser blocks for elevating the platform above the floor or other support surface so that the top surface of the platform extends parallel to the support surface. Users of The Step repeatedly step on and off the horizontal top surface of the elevated platform to engage in aerobic exercise. The elevated platform may also be used in connection with other types of exercise.

The platform of The Step is adjustable in height by adding or subtracting riser blocks. The top faces of the riser blocks of The Step are shaped to be matingly engageable with the bottom of the platform to provide a sturdy, elevated top surface that extends parallel to the ground for stepping exercise or other exercise purposes. The top faces of the riser blocks are also alternatively engageable with bottom surfaces of other riser blocks to readily elevate the platform to the desired height. Because they are matingly engageable with each other, the riser blocks also can be readily stacked for storage purposes.

With The Step product, pairs of riser blocks are positioned underneath the platform, with one of each pair being positioned under each end of the platform. In such an arrangement, two riser blocks are needed for each incremental height adjustment. Each riser block may instead span the substantial length of the platform in which case one additional riser block is stacked for each incremental height adjustment. Examples of stepping exercise devices are disclosed in U.S. Pat. Nos. 5,318,489, 5,158,512; D330,057; and 5,672,144, all of which are incorporated herein by reference.

The present disclosure relates to an inclined riser block and to an adjustable exercise device that includes one or more inclined riser blocks for readily elevating and inclining a platform to enable stepping and other exercises to be readily performed on the inclined top surface of the platform. The inclined riser blocks are matingly engageable with the bottom of the platform to elevate and incline the platform. Each inclined riser block may include a top face extending at an incline for matingly engaging the bottom of the platform, a bottom face, and a central portion extending between the top and bottom faces and having a front and a rear, the central portion increasing in thickness from the front to the rear.

The inclined riser blocks may be configured to be matingly engageable with the bottom of the platform at alternative positions of the inclined riser blocks relative to the platform so that the platform may be inclined alternatively along either the width or length of the platform. When the platform is inclined along its width, the exercise device may be used, for example, in connection with aerobic stepping exercise where the user steps on and off the inclined top surface of the platform or in connection with any other form of exercise. When the platform is inclined along its length, the exercise device may be used, for example, in connection with bench pressing or in connection with other weight lifting exercise or any suitable form of non-aerobic or aerobic exercise.

The inclined riser blocks in accordance with the present disclosure may be used to provide additional exercise options to target different muscle groups. The inclined riser blocks may be used with other exercise device components and may, for example, be used with commercially available stepping products to provide alternative adjustment or positioning means to adjust or orient the platform at alternative positions. In accordance with one embodiment of the present disclosure, the inclined riser blocks may complement The Step product so that the inclined risers are matingly engageable with The Step platform, and so that The Step riser blocks are also alternatively matingly engageable with the inclined riser blocks to adjustably elevate the inclined riser blocks. Such a combination provides an exercise device that can be used to orient the platform at several alternative positions, depending upon the combination and construction of components. For example, the platform can also be elevated and inclined along its width by including the inclined riser blocks and positioning the inclined riser blocks in a first orientation or position relative to the platform. Further, the platform can alternatively be elevated along its length by re-orienting or re-positioning the inclined riser blocks relative to the platform. With such configuration, one of the inclined riser blocks may be elevated higher than the other inclined riser block by one or more riser blocks. With either of these configurations, the platform can also be adjustably elevated to different heights by engaging a corresponding number of riser blocks with the bottoms of the inclined riser blocks. The inclined riser blocks may, for example, be sold with other exercise device components or be sold separately as a kit or otherwise for use with other exercise device components.

Additional features will become apparent to those skilled in the art upon consideration of the following detailed description of drawings exemplifying the best mode as presently perceived.

BRIEF DESCRIPTION OF THE DRAWINGS

The detailed description particularly refers to the accompanying figures in which:

FIG. 5(*b*) being a perspective top view of one of the riser blocks of the prior art stepping structure; and FIG. 5(*c*) being a bottom perspective view of the platform of the prior art stepping structure;

DETAILED DESCRIPTION OF ILLUSTRATIVE EMBODIMENT

Figure 1:
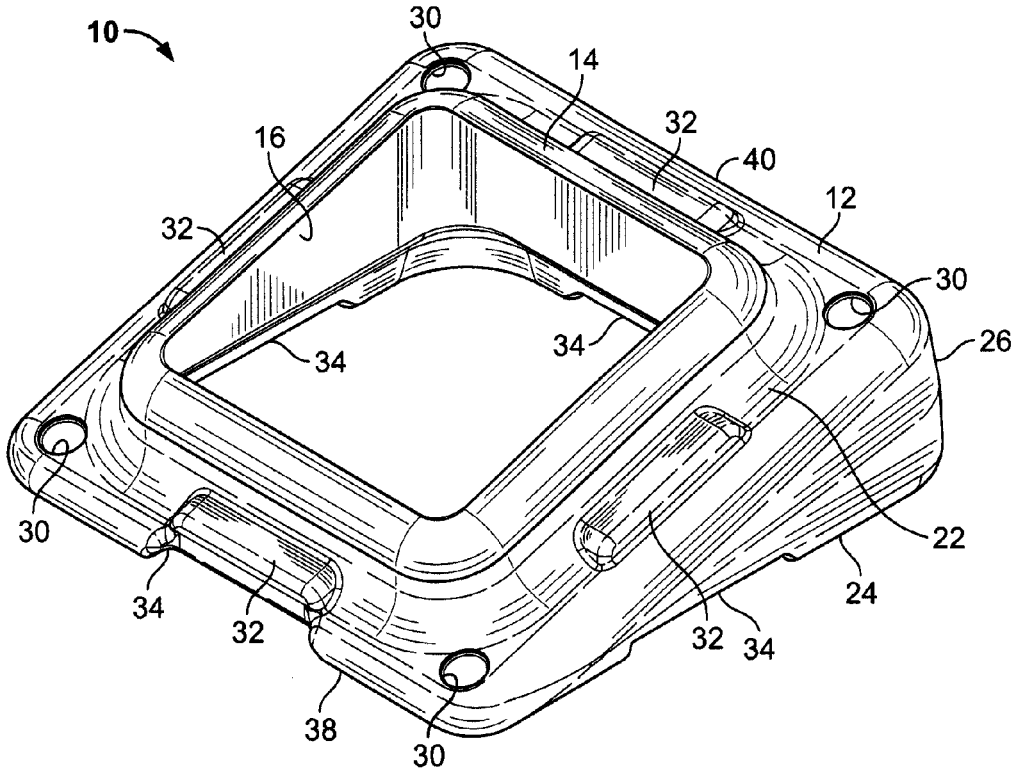
FIG. 1 is a perspective top view of an inclined riser block in accordance with an embodiment of the present disclosure.
Figure 2:
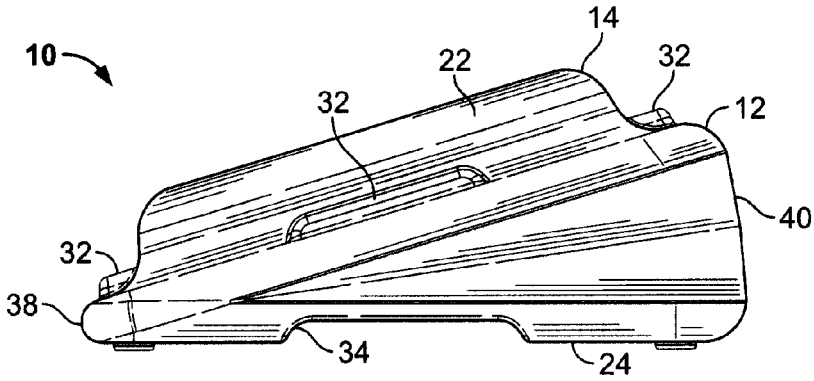
FIG. 2 is a side plan view of the inclined riser block of FIG. 1.
Figure 3:
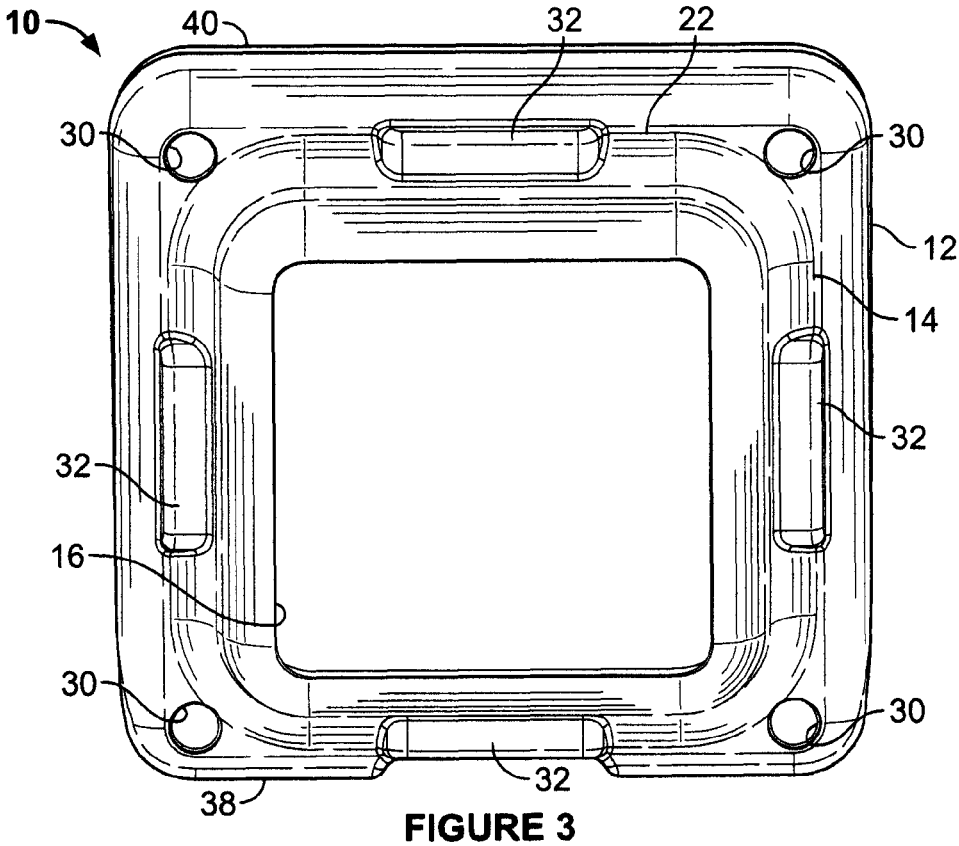
FIG. 3 is a top plan view of the inclined riser block of FIG. 1.
Figure 4:
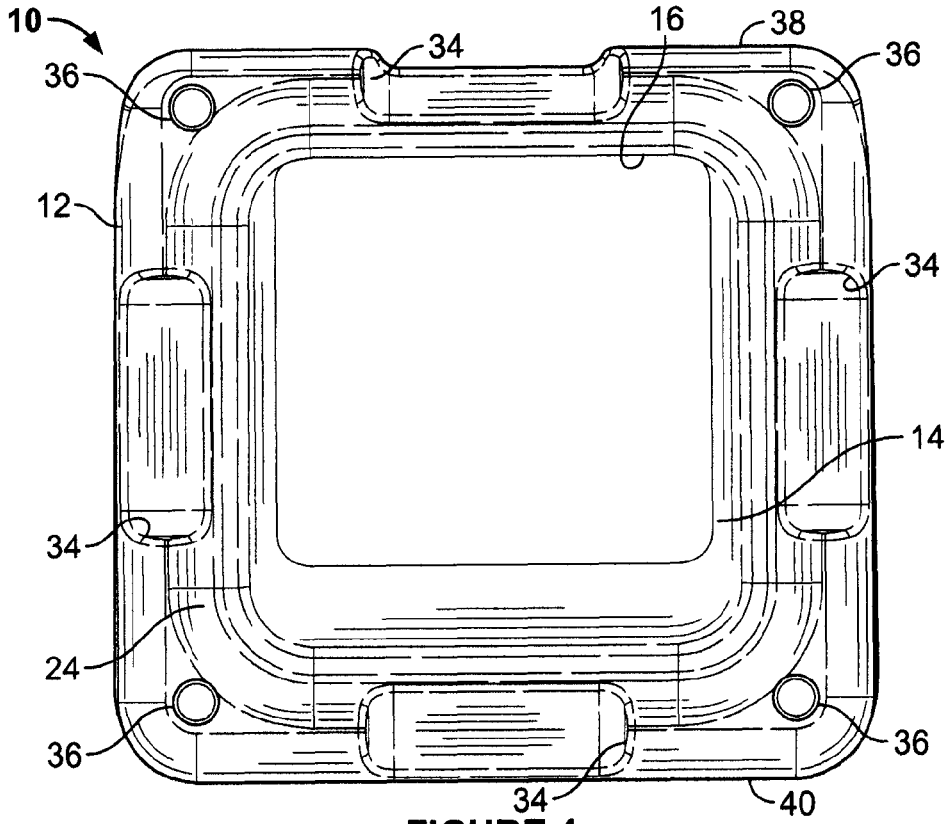
FIG. 4 is a bottom plan view of the inclined riser block of FIG. 1.

While the present disclosure may be susceptible to embodiment in different forms, there is shown in the drawings, and herein will be described in detail, embodiments with the understanding that the present description is to be considered an exemplification of the principles of the disclosure and is not intended to limit the disclosure to the details of construction and the arrangements of components set forth in the following description or illustrated in the drawings.

FIGS. 1-4 illustrate an inclined riser block 10 in accordance with an illustrated embodiment of the present disclosure. The illustrated inclined riser block 10 includes a square or otherwise rectangular flange 12 and a square or otherwise rectangular protrusion 14 that forms a rectangular aperture 16. The flange 12 and protrusion 14 define a top face 22, a bottom face 24 and a central portion 26 of the inclined riser block 10. The top face 22 defines in each corner a circular recess 30. The top face 22 includes four rectangular dimples 32, one rectangular dimple formed along each side of the flange 12. The top face 22, including the flange 12 and the protrusion 14, extends at an incline relative to the bottom face 24 and relative to a floor or other support surface when the bottom face is resting on the support surface. The angle of incline may be in the range of about 17 degrees, or may have any other suitable magnitude in accordance with other embodiments. The bottom face 24 defines four rectangular slots 34, one along each side of the bottom of the flange 12, and includes a boss 36 in the form of a rubber stop or the like in each corner. The central portion 26 interconnects the top and bottom faces 22 and 24. The height or thickness of the central portion 26 increases from the front 38 of the central portion 26 to the rear 40 of the central portion, forming the incline on the top face 22.

Figure 6:
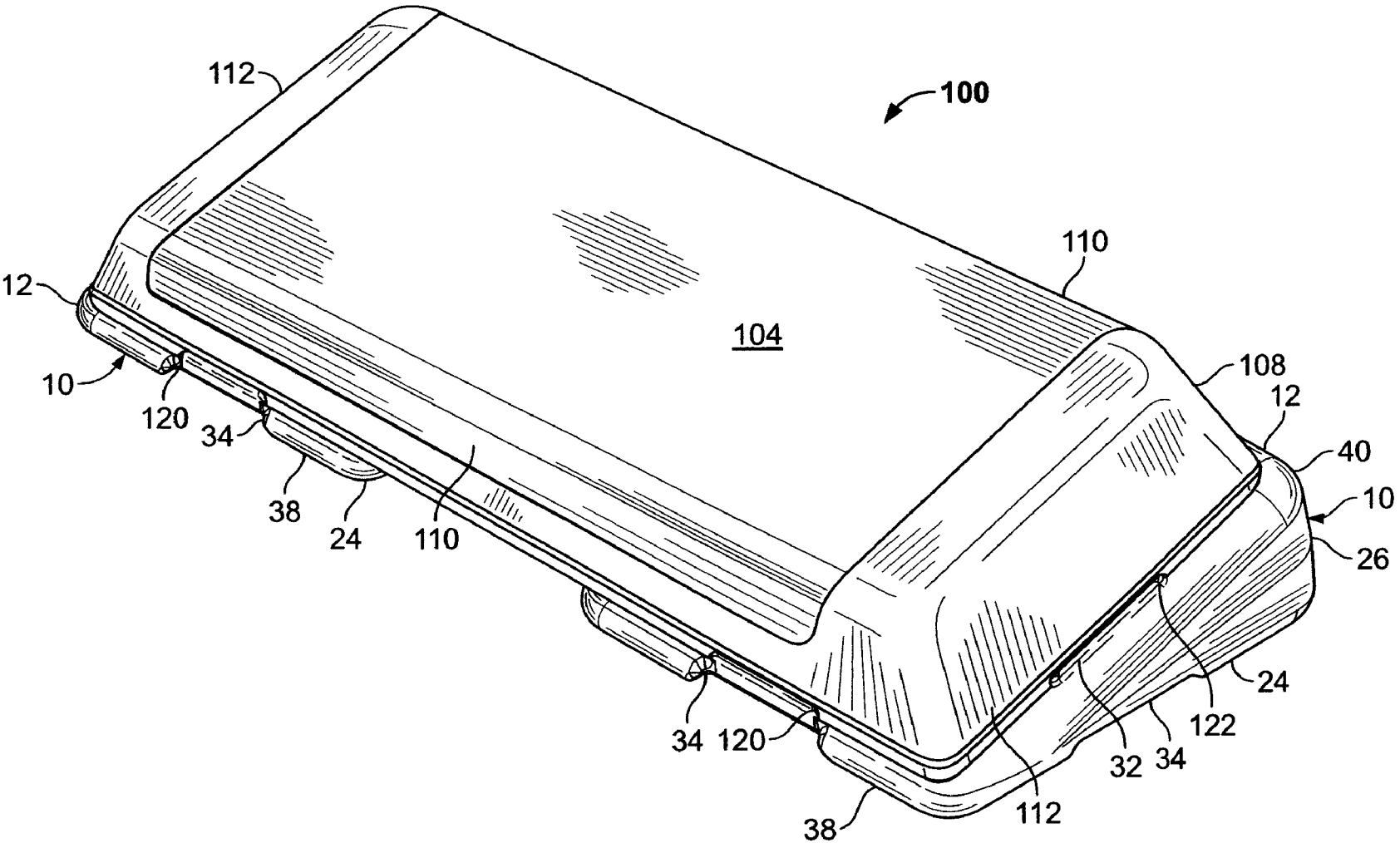
FIG. 6 is a combination of a pair of inclined riser blocks of FIG. 1 and the platform of the stepping structure of FIG. 5(*a*)
Figure 7:
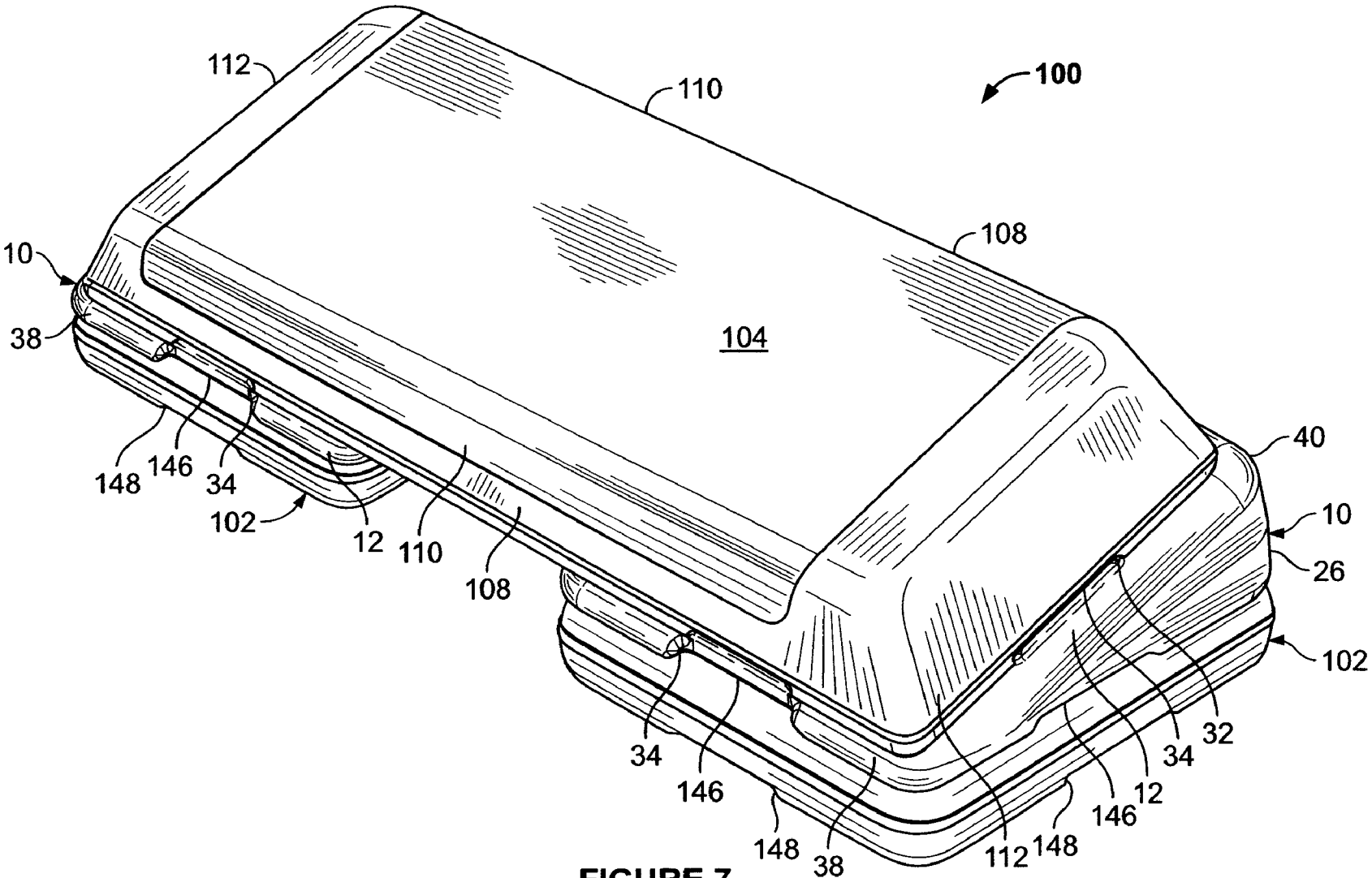
FIG. 7 is a combination of a pair of inclined riser blocks of FIG. 1 and components of the stepping structure of FIG. 5(*a*), illustrating the platform inclined along its width by a combination of inclined riser blocks and riser blocks.
Figure 8:
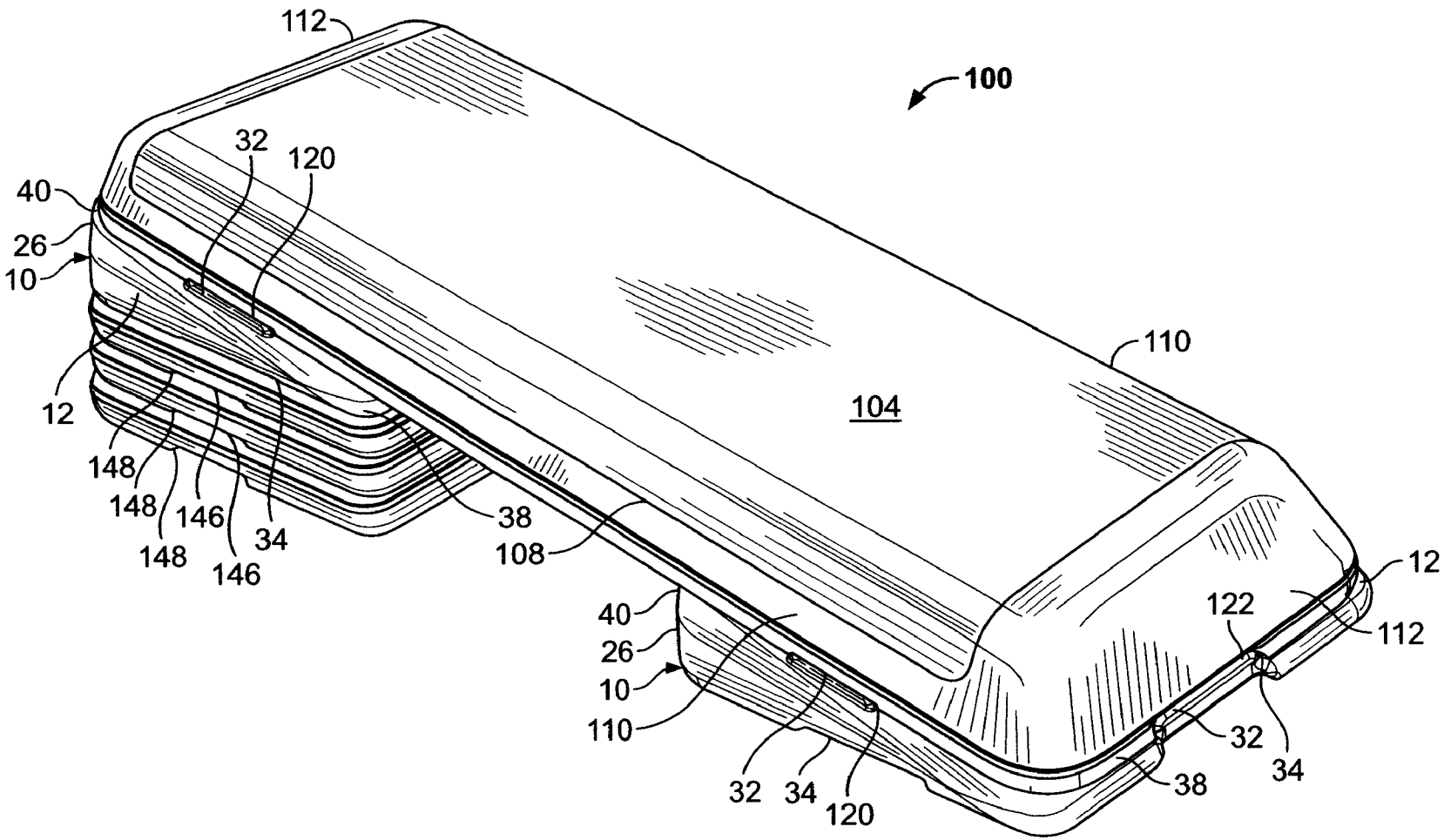
FIG. 8 is a combination of a pair of inclined riser blocks of FIG. 1 and components of the prior art stepping structure of FIG. 5(*a*), illustrating the platform inclined along its length by a combination of inclined riser blocks and riser blocks.

The inclined riser block 10 may be used with any suitable stepping exercise device or other exercise device. As shown in FIGS. 6-8, for example, the inclined riser block 10 may be combined with one or more components of The Step product shown in FIG. 5(*a*)-5(*c*), which includes a platform 100 and a plurality of riser blocks 102 for elevating the platform 100 to be parallel above a floor or other support surface. The illustrated prior art platform 100 includes a flat top surface 104, a bottom 106, and a support wall 108 extending downward along the perimeter of the top surface. The support wall 108 includes a pair of opposed side walls 110 and a pair of opposed end walls 112, defining a recess 114 on the bottom 106 of the platform 100 that extends substantially along the length of the platform. The support wall 108 also defines on the opposed side walls 110 a pair of rectangular recesses 120 adjacent each end wall 112 and a rectangular recess 122 on each end walls. The support wall 108 also includes in each corner a boss 124 in the form of a rubber stop or the like.

Figure 5A:
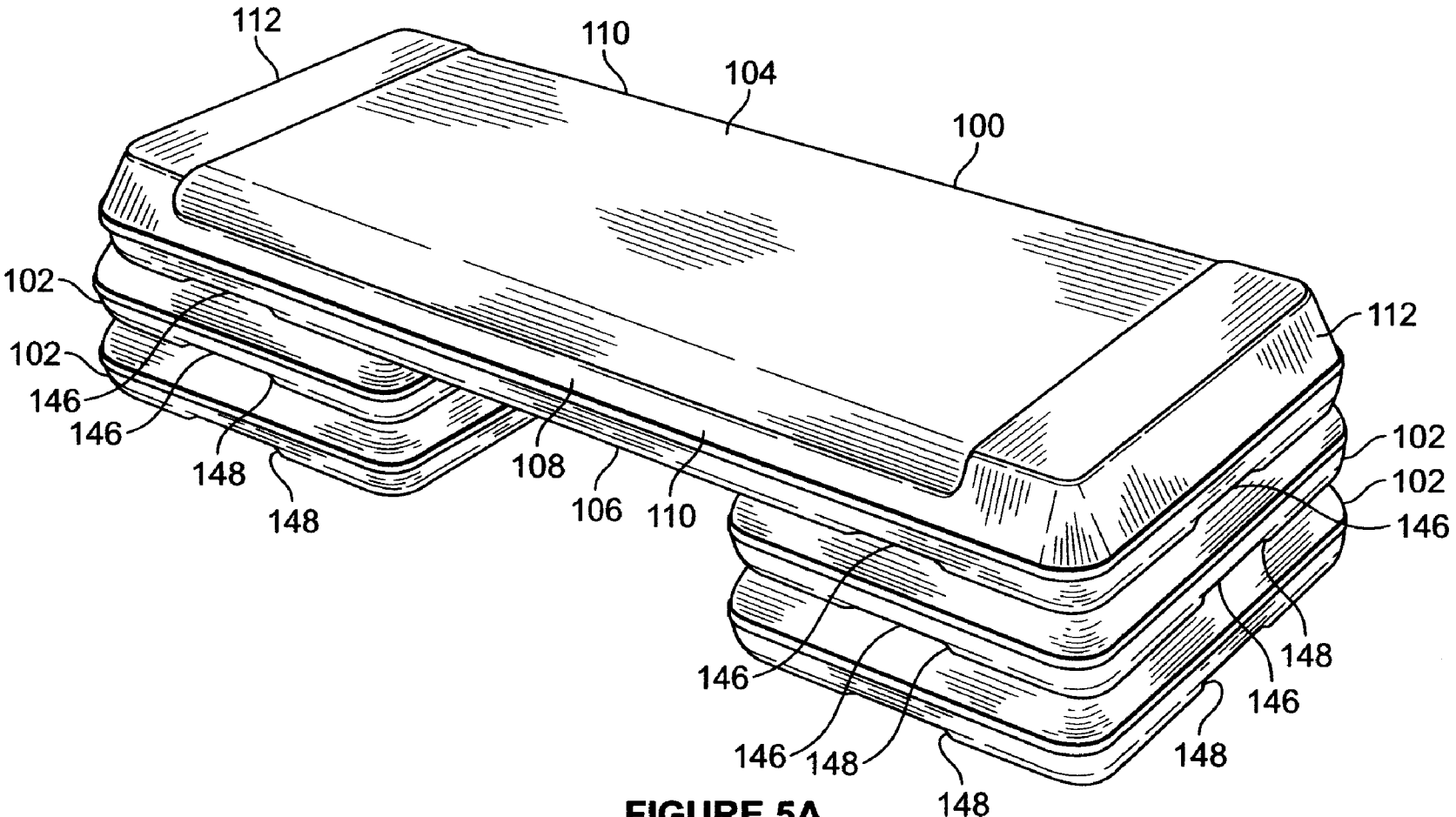
FIGURE 5A (PRIOR ART)
FIGS. 5(*a*)-5(*c*) illustrate a prior art stepping structure, with FIG. 5(*a*) being a perspective view of the prior art stepping structure.
Figure 5B:
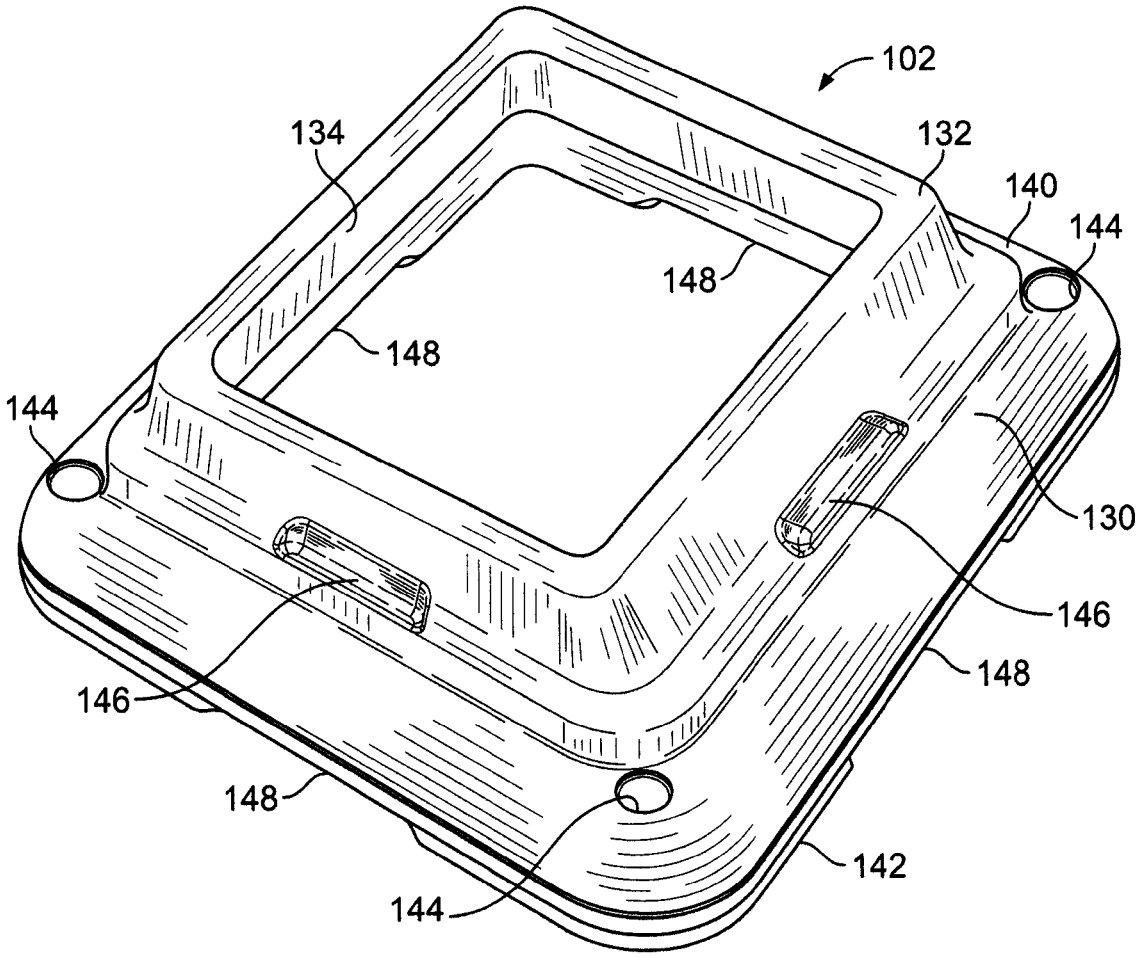
FIGURE 5B (PRIOR ART)
Figure 5C:
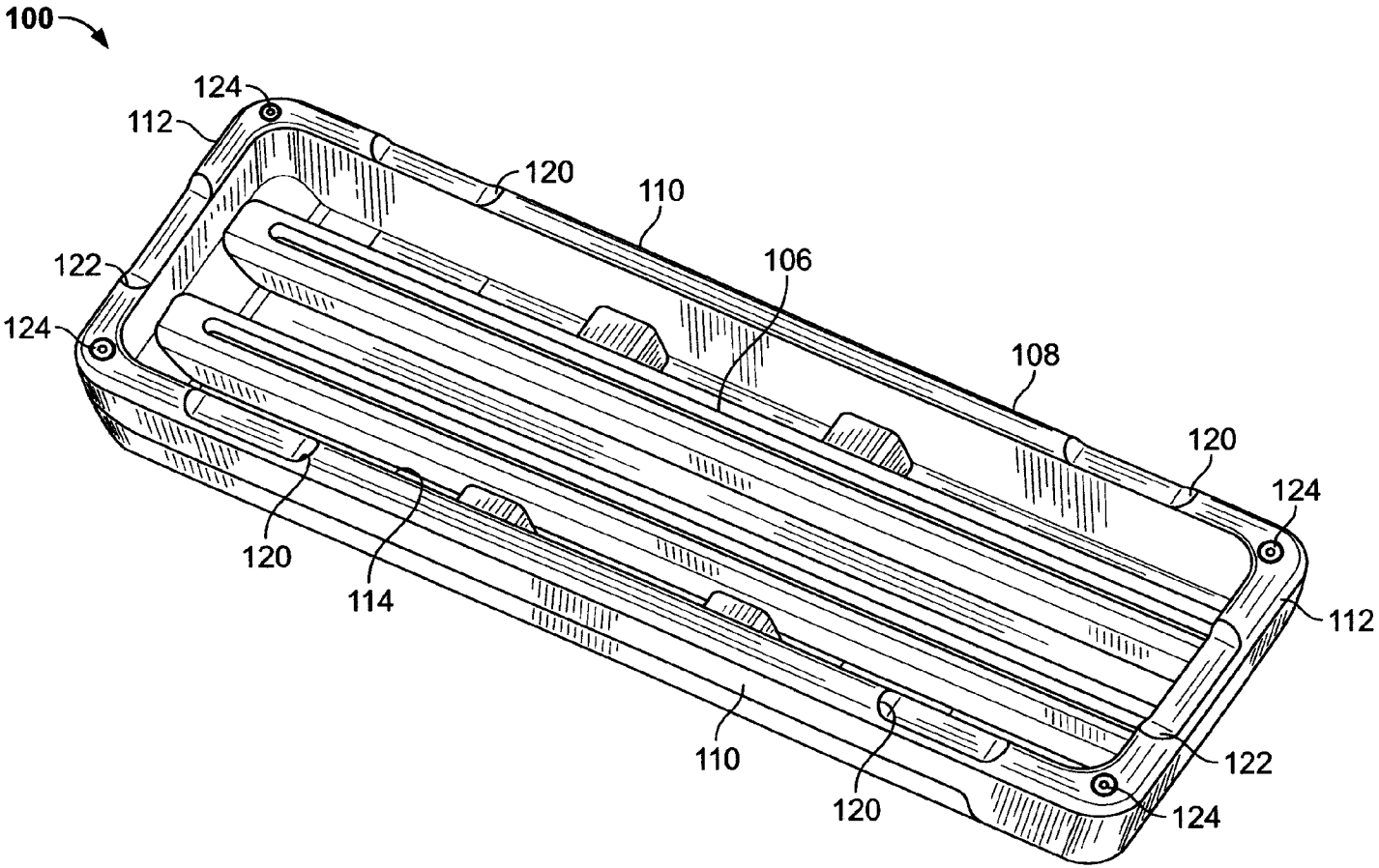
FIGURE 5C (PRIOR ART)

Each of the prior art riser blocks 102 illustrated in FIGS. 5(*a*)-(*c*) includes a square flange 130 and a square protrusion 132 that forms a square aperture 134 and that define top and bottom faces 140 and 142 of the riser blocks. The top face 140 defines adjacent each corner a circular recess 144. The top face 140 includes four rectangular dimples 146, one rectangular dimple formed along each side of the top of the flange 130. The bottom face 142 defines four rectangular slots 148, one along each side of the bottom of the flange 130, and includes a boss (not shown) in the form of a rubber stop or the like in each corner.

With the configuration illustrated in FIG. 6, for example, a pair of the inclined riser blocks 10 are matingly engaged with the platform 100 to incline the platform 100 along its width (i.e., the incline extends from one of the opposed side walls 110 of the platform 100 to the other) so that stepping or other exercise can occur on the inclined top surface 104 of the platform 100. The inclined riser blocks 10 are matingly engaged with the bottom 106 of the platform 100 adjacent opposite ends of the platform 100. When engaged, the protrusion 14 of each inclined riser block 10 is received by the recess 114 of the platform 100, dimples 32 of the inclined riser block 10 are received by two of the rectangular recesses 120 and one of the rectangular recesses 122 of the platform 100, and bosses 122 of the platform 100 are received by circular recesses 30 of the inclined riser block 10. In FIG. 6, the axis extending from the front 38 to the rear 40 of the central portion 26 of each inclined riser block 10 extends perpendicular to the length of the platform 100. The bottoms of the flanges 12 of the inclined riser blocks 10 rest on the floor or other support surface.

Alternatively, the exercise device can be configured as illustrated in FIG. 7. In this configuration, the platform 100 is further elevated by disposing riser blocks 102 underneath and in mating engagement with the inclined riser blocks 10. In this regard, the structure on the top face 22 of the inclined riser blocks 10 (including the protrusion 14, recesses 30 and dimples 32) is substantially similar to the structure on the top face 140 of the riser block 102 except that the structure on the top face 22 of the inclined riser block 10 extends at an incline relative to the bottom face 24 of the inclined riser block; and the structure on the bottom face 24 of the inclined riser block 10 (including the slots 34 and the bosses 36) is substantially similar to the structure on the bottom face 142 of the riser block. When the top faces 140 of the riser blocks are matingly engaged with the bottom faces 24 of the inclined riser block 10, the dimples 146 of the riser blocks are received by the slots 34 of the inclined riser block 10, the protrusions 132 of the riser blocks are received by the aperture 16 of the inclined riser block 10, and the bosses 36 of the inclined riser blocks 10 are received by the circular recesses 144 of the inclined riser block 10. The bottoms of the flanges 130 of the riser blocks 102 rest on the floor or other support surface.

Alternatively, the exercise device can be configured as illustrated in FIG. 8. In this configuration, a pair of the inclined riser blocks 10 are matingly engaged with the platform 100 to incline the platform 100 along its length (i.e., the incline extends from one of the opposed end walls 112 of the platform 100 to the other), and three riser blocks 102 are disposed underneath one of the inclined riser blocks 10. The inclined riser blocks 10 are engaged with the bottom 106 of the platform 100 adjacent opposite ends of the platform 100. The bottom riser blocks 102 rest on the floor or other support surface. In FIG. 8, three risers 102 are disposed underneath one of the inclined riser blocks 102 so that it is higher than the other inclined riser block and to provide a sturdy incline. In the configuration of FIG. 8, the number of riser blocks 102 disposed underneath one side of the platform 100 may depend upon the angle of incline of the top faces 22 of the inclined riser blocks 10. If the angle of incline is 17 degrees and no riser blocks 102 are disposed underneath the other inclined riser block 10, for example, four inclined risers may be disposed underneath the other inclined riser block 10. As in the configurations of FIGS. 6 and 7, in the configuration of FIG. 8, the height of the platform 100 can be readily adjusted by adding or subtracting riser blocks 102.

In the configuration of FIG. 8, the inclined riser blocks 10 are engaged with the platform 100 in the same manner as in FIGS. 6 and 7, except that the inclined riser blocks 10 are oriented such that the incline of the platform 100 extends parallel to the length of the platform 100. Stated another way, in FIG. 8, the axis extending from the front 38 to the rear 40 of the central portion 26 of each of the inclined riser blocks 10 extends parallel to the length of the platform 100; whereas in FIGS. 6 and 7 the axis extends perpendicular to the length of the platform 100. Thus, the difference in orientation of the inclined riser blocks 10 relative to the platform 100 in FIG. 8 relative to FIGS. 6 and 7 is 90 degrees. Because of their symmetrical construction, the riser blocks 102 may or may not be oriented in different positions in FIGS. 6, 7, and 8 relative to the inclined riser block 10.

Combining the inclined riser block 10 with other stepping structure components, such as the stepping structure of FIGS. 5(*a*)-(*c*), provides alternatives to exercise enthusiasts. In the configuration of FIG. 6, for example, the exercise device can be used in aerobic stepping exercise or other forms of exercise that are suitable on an elevated and inclined surface. In the alternative configuration of FIG. 7, riser blocks may be added to position the inclined platform 100 at an increased height, providing further alternatives to the exercise enthusiasts. In the configuration of FIG. 8, the exercise device can be used in connection with bench pressing or any other exercise that can be performed on a platform 100 inclined along its length. In the configurations of FIGS. 6, 7 and 8, the height of the platform 100 can be readily adjusted by adding or subtracting riser blocks 102.

The inclined riser block 10 in accordance with the present disclosure may have any other suitable construction and may include any other suitable engaging structure or otherwise be matingly engageable with other components in any other suitable manner. Similarly, the platform 100 and, if included, the risers 102 may have any other suitable construction and may include any other engaging structure or otherwise be matingly engageable with one or more inclined risers 10 in any other suitable manner. Additionally, the inclined riser block 10 and the platform 100 may be constructed in any suitable manner such that a single individual inclined riser block 10 or more than two inclined riser blocks can be used to elevate and incline the platform 100, and, if included, one or more riser blocks can be constructed in any complementary manner. The flat top surface 104 of the platform 100 may include any other suitable construction or configuration thereon or include any suitable structure secured thereto to complement or facilitate any form of exercise.

While a preferred embodiment of the disclosure is shown and described, it is envisioned that those skilled in the art may devise various modifications and equivalents without departing from the spirit and scope of the disclosure. The present disclosure relates to one or more of the following features, elements, steps, or combinations thereof.

What is claimed is:

1. A kit for providing alternative adjustability to an aerobic exercise device including: (a) a platform having a substantially flat top surface and a bottom defining a recess, and (b) a pair of riser blocks having top faces matingly engageable with the bottom of the platform to elevate the platform above a support surface so that the top surface of the platform extends above the support surface, the kit comprising a pair of inclined riser blocks, each inclined riser block comprising:

(a) a top face with at least one protrusion forming an interlocking surface matingly engageable with the recess defined by the bottom of the platform whereby the top face stably supports the platform;

(b) a bottom face matingly engageable with the top face of a respective riser block;

(c) a central portion extending between the top and bottom faces of the inclined riser block and having a front and a rear, the central portion increasing in thickness from the front to the rear; and (d) whereby the top face extends at an incline with respect to the bottom face so that the top surface of the platform can be inclined relative to the support surface, and wherein the inclined riser blocks are matingly engageable with the bottom of the platform at two alternative positions of the inclined riser blocks to incline the platform alternatively along a width or a length of the platform.

2. The kit of claim 1 wherein the central portion of each inclined riser block includes an axis extending from the front to the rear of the central portion, the axis extending perpendicular to the length of the platform when the inclined riser block is matingly engaged with the bottom of the platform at a first position of the inclined riser block, and the axis extending parallel to the length of the platform when the inclined riser block is matingly engaged with the bottom of the platform at a second position of the inclined riser block.

3. The kit of claim 2 wherein each inclined riser block further includes a plurality of dimples receivable by a plurality of slots defined by the platform to matingly engage the platform and the inclined riser block.

4. The kit of claim 3 wherein each inclined riser block further includes a plurality of dimples, a first plurality of the dimples receivable by slots of the platform to matingly engage the inclined riser block with the platform at the first position of the inclined riser blocks, a second plurality of the dimples receivable by slots of the platform to matingly engage the inclined riser block with the platform at the second position of the inclined riser blocks and wherein the first plurality of the dimples is a different set of dimples than the second plurality of dimples.

5. The kit of claim 1 wherein the protrusion defines an aperture and the aperture is closer to the front than to the rear.

6. The kit of claim 1 wherein the top face is inclined at an angle in the range of about 17 degrees relative to the support surface.

7. Means for alternatively adjusting an aerobic exercise device including: (a) a platform having a substantially flat top surface and a bottom defining a recess, and (b) a plurality of riser blocks having top faces matingly engageable with the bottom of the platform to elevate the platform above a support surface so that the top surface is above the support surface, the adjusting means comprising at least one inclined riser block matingly engageable with the platform for elevating the platform and inclining the top surface of the platform relative to the support surface in alternative orientations, the inclined riser block including:

(a) a top face with at least one protrusion forming an interlocking surface matingly engageable with the recess defined by the bottom of the platform whereby the top face stably supports the platform;

(b) a bottom face matingly engageable with the top face of the riser block; and (c) a central portion extending between the top and bottom faces of the inclined riser block and having a front and rear, the central portion increasing in thickness from the front to the rear; and (d) whereby the top face extends at an incline with respect to the bottom face so that the top surface of the platform can be inclined relative to the support surface, and wherein the inclined riser block is matingly engageable with the bottom of the platform at two alternative positions of the inclined riser block to incline the platform alternatively along a width or a length of the platform.

8. The adjusting means of claim 7 wherein there are two inclined riser blocks and wherein one of the inclined riser blocks is elevated above the other inclined riser block by at least one of the riser blocks when the platform is inclined along the length of the platform.

9. The adjusting means of claim 8 wherein each inclined riser block includes a plurality of dimples receivable by slots defined by the bottom of the platform to matingly engage the platform and the inclined riser block.

10. The adjusting means of claim 7 comprising a pair of inclined riser blocks wherein one of the inclined riser blocks is matingly engageable with the platform adjacent a first end of the platform and the other inclined riser block is matingly engageable with the platform adjacent a second end of the platform.

11. In combination with an aerobic exercise device comprising (a) a platform having a substantially flat top surface and a bottom defining a recess and having a length and a width, and (b) a pair of riser blocks having top faces matingly engageable with the bottom of the platform to position the platform at a first position where the platform is elevated above the support surface and the top surface is parallel to the support surface, means for alternatively adjusting the exercise device between the first position, a second position where the platform is elevated above the support surface and the top surface is inclined relative to the support surface along the width of the platform, and a third position where the platform is elevated above the support surface and the top surface is inclined relative to the support surface along the length of the platform, the alternative adjusting means comprising a pair of inclined riser blocks, each inclined riser block including:

(a) a top face extending at an incline with at least one protrusion forming an interlocking surface matingly engageable with the recess defined by the bottom of the platform whereby the top face stably supports the platform;

(b) a bottom face matingly engageable with the top face of the riser block;

(c) a central portion extending between the top and bottom faces of the inclined riser block and having a front and rear, the central portion increasing in thickness from the front to the rear and defining an axis extending from the front to the rear; and (d) whereby the top face extends at an incline with respect to the bottom face so that the top surface of the platform can be inclined relative to the support surface, and wherein each inclined riser block is matingly engageable with the bottom of the platform at two alternative positions of the inclined riser block to incline the platform alternatively along a width or a length of the platform.

12. The adjusting means of claim 11 wherein the inclined riser blocks are matingly engageable with the bottom of the platform at two alternative orientations of the inclined riser blocks relative to the platform, the axis of each inclined riser block extending perpendicular to the length of the platform when the exercise device is in the second position, and the axis of each inclined riser block extending parallel to the length of the platform when the exercise device is in the third position.

13. The adjusting means of claim 11 wherein each inclined riser block further includes a plurality of dimples receivable by a plurality of slots defined by the platform to matingly engage the platform when the exercise device is in the second and third positions.

14. The adjusting means of claim 11 wherein one of the inclined riser blocks is engaged with and elevated by at least one of the riser blocks when the exercise device is in the third position.

* * * * *